United States Patent [19]

Duckworth

[11] 4,095,944

[45] Jun. 20, 1978

[54] TREATMENT OF TEXTILE MATERIALS

[75] Inventor: Clifford Duckworth, Shipley, England

[73] Assignee: Mather & Platt Limited, Park Works, England

[21] Appl. No.: 693,244

[22] Filed: Jun. 4, 1976

Related U.S. Application Data

[63] Continuation of Ser. No. 494,799, Aug. 5, 1974, abandoned.

[30] Foreign Application Priority Data

Aug. 4, 1973 United Kingdom ..... 37107/73

[51] Int. Cl.[2] ..... D06M 9/04; D06M 1/10

[52] U.S. Cl. ..... 8/115.7; 8/125

[58] Field of Search ..... 8/125, 115.7

[56] References Cited

U.S. PATENT DOCUMENTS

| | | | |
|---|---|---|---|
| 2,142,043 | 12/1938 | Boyd | 8/125 |
| 2,447,914 | 8/1948 | Ruperti | 8/125 |
| 3,449,060 | 6/1969 | Schenck | 8/125 |

FOREIGN PATENT DOCUMENTS

| | | | |
|---|---|---|---|
| 825,608 | 12/1959 | United Kingdom | 8/125 |
| 1,142,385 | 2/1969 | United Kingdom. | |

*Primary Examiner*—Carman J. Seccuro

*Attorney, Agent, or Firm*—Sughrue, Rothwell, Mion, Zinn and Macpeak

[57] ABSTRACT

A novel method of mercerization in which the cellulosic textile material is saturated for a period of 60 seconds or less and preferably 10 seconds or less in a solution of an alkaline swelling agent, usually caustic soda at a concentration of 8.75% or more and at a temperature of 50° C or more.

11 Claims, 3 Drawing Figures

10
11
12
13
14
15
16
17
18
19
20
21
22
D
F
OF
S

TREATMENT OF TEXTILE MATERIALS

This is a continuation of application Ser. No. 494,799 filed Aug. 5, 1974, now abandoned.

This invention relates to a method of and apparatus for the treatment of cellulosic textile materials by a variety of swelling agents such as certain alkalies and salts.

One of the methods best known and universally practised is that termed "Mercerisation" and a number of beneficial effects are produced amongst which are increases in the values of the properties of dyestuff affinity, tensile strength and lustre, and improved coverage of "dead cotton" and increased dimensional stability to laundering.

Mercerisation is commonly applied to textile materials of a cellulosic nature, especially cotton, linen and blends or mixtures of such with other natural or man-made fibres.

By "textile material" is to be understood herein and in the claims a wide variety of structures such as woven fabric, knitted fabric, yarn, non-woven webs or cellulosic material reconstituted as ribbon or film, or structures comprising various combinations of the same.

To produce full mercerisation and the maximum development of the above properties, long established theory and practice has laid down the necessary chemical and process conditions, the process sequence and apparatus requirements.

Woven cotton fabric is the most common textile material which undergoes mercerisation and caustic soda is almost exclusively used as a swelling agent, being relatively cheap, capable of regeneration and widely available in various physical forms and concentrations.

An example therefore of the mercerisation method of long established practice, a fabric is impregnated with a solution of caustic soda of a strength between 45° TW to 60° TW (26° Be to 33° Be or 20% to 27%) for a period of not less than 45 seconds and at a temperature between 5° to 20° C. The fabric is then washed with hot water and certain tension conditions imposed and maintained upon the fabric during the washing until the fabric contains less than 5% caustic soda. Thereafter, residual caustic soda may be finally removed by further washing and or neutralisation without tension control.

For woven fabrics there are two main forms of apparatus by which the aforesaid tension control is achieved and which have long been known to those skilled in the textile art.

One is known as chainless mercerising in which fabric shrinking during impregnation, squeezing out and subsequent washing is largely prevented; fabric may be prevented from shrinking lengthwise or in warp direction, or indeed may be beneficially extended, but the apparatus is generally incapable of preventing some shrinkage in width during processing and even less capable of extending a fabric in width direction where for any reason earlier width shrinkage has occurred.

The other form is known as chain mercerising and is distinguished by the use of apparatus for stretching the fabric in a weft direction, between impregnation and the washing stages in which the selected tension conditions are maintained as earlier described.

Mercerising of cotton yarn is also extensively carried out, the yarn being either wound in hank form, or in the form of a ribbon or rope of continuous threads.

In common practice with fabric mercerisation, yarn mercerising has depended upon the impregnation with caustic soda of defined concentrations, specific times and low temperatures, and the imposition and maintenance of tension during the removal of caustic soda by washing.

There is a considerable latitude permitted in the concentration of caustic soda which is to be used.

Some of the effects of mercerisation begin at as low a concentration of 20° TW (13° Be or 3.75%) NaoH and the choice of caustic concentration depends upon the balance of resultant fabric properties which is required, and also cost.

The application and control of tension as earlier described is absolutely necessary to produce an increase in lustre and optimum in tensile strength.

Likewise, the time of impregnation and temperature of caustic soda have thus far been considered equally important in correct mercerisation.

Times of 45 to 60 seconds have become general practice in commercial mercerisaton in spite of theoretical consideration that 3 minutes is required for the optimum effect if carried out on a single cotton hair.

As regards temperature, it is common practice to have the solutions of caustic soda at a low level. It was long the practice to refrigerate the caustic soda liquor to less than 10° C and it is still common to cool it to less than 18° C.

The basic process and apparatus has changed little since Lowe's patents of 1889/90 which improved upon the original patent by Mercer in 1851. Meticulous and extensive research work into the theories underlying mercerisation was carried out especially in the years 1900–1925 and the book "Mercerising" by J. T. Marsh, Chapman Hall, records summaries from much of such investigations.

Respecting the effect of temperature it is recorded that "when the temperature was increased the action of the alkali on the cotton was retarded" and also "the best effects are obtained with solutions of usual concentration at room temperatures: as the temperature increases the mercerising effect diminishes in the case of NaoH".

All such work confirmed Mercer's original work in which caustic soda of the specified concentrations was used at 60° F or under.

It is an object of the present invention to provide an improved mercerisation method and apparatus, whereby many of the handicaps and difficulties associated with the traditional methods and apparatus are greatly reduced but without lessening the established benefits of the mercerisation process, while at the same time substantially improving other properties of the processed textile material and providing economic advantages in the operation of the method and the apparatus.

We have now discovered quite unexpectedly that these advantages arise by employing caustic soda within the conventional concentrations for "semi" and "full" mercerisation but at greatly elevated temperatures, preferably closely approaching the boiling point appropriate to the concentration of caustic soda being employed. Indeed the only handicap arising from the use of such solutions at their boiling point is on account of safety and cost.

The time of treatment previously referred to is commonly taken to be that from when the material is first immersed in caustic soda to the point when the impregnated textile material is first brought into contact with wash water. For chain mercerisers the necessary dwell time is obtained by the provision of timing drums which reduce the time a textile material is actually immersed in the caustic soda solution.

Such timing drums are not usually employed in chainless mercerisers and the bulk of the dwell time is that time of dwell within the caustic soda solution.

In the method of this invention it has been found that to obtain all the expected benefits of mercerisaton the total dwell time as defined above may be reduced to 15 seconds or less according to the geometry of the textile material structure and the processing sequence in which mercerising takes place.

For example, it has been found that mercerisation according to this invention may be carried out on scoured, bleached or otherwise absorbent textile material for a total dwell time of less than 10 seconds. Preferably, however, for economic and technical reasons the method of the invention is carried out on loomstate material, in which while it can be demonstrated that "wetting out" with the treatment liquor is less than 2 seconds, the actual dwell time is beneficially extended to 15 seconds.

However, it has also been found that for the enhancement of other properties not usually associated with normal mercerising and for the production of novel effects the "dwell times" may be extended in order to develop such properties without detriment to the established benefits.

We therefore depart from the traditional method of defining dwell time and use two terms to define the total time between the first saturating with the treatment liquor and first bringing into contact with wash water.

The first term is "immersion time" and is used herein and the claims to mean the time which elapses between the textile material first contacting the treatment liquor and the point at which the saturated material leaves the last squeezing means of the saturator, whereas the second term, "reaction time", is used herein and the claims to mean the time elapsing between the saturated textile material leaving the squeezing means to the point when the said textile material first contacts the washing liquor.

Furthermore, while saturation within a treatment liquor is known to be improved by allowing the textile material to be so processed with the minimum of warp, and also of weft tension it is especially beneficial in the method of our invention.

According to the present invention there is provided a method of mercerising cellulosic textile materials comprising the steps of presenting the textile material for saturation with an alkaline swelling agent at a concentration of 8.75% or more and at a temperature of 50° C or more for an immersion time of 60 seconds or less, and squeezing excess treatment liquor from the textile material.

Preferably, the immersion time is 10 seconds or less.

Preferably also, the method includes the step of controlling the textile material during the immersion time in respect of changes in length and/or in width.

Preferably also, the method further includes the steps, after squeezing, of delivering the textile material to a draw nip device, and controlling, between squeezing and the draw nip device, the textile material in respect of changes in length and/or width during a reaction time in excess of 1 second.

The alkaline swelling agent is preferably caustic soda at concentrations between 20° TW and 69° TW, or between 13° Be and 37° Be, such hydrometer degrees being measured at a datum temperature of 15° - 20° C, or the equivalent concentration of 8.75% to 31%, at temperatures in excess of 50° C and preferably near to the boiling point appropriate to the chosen concentration of treatment liquor for an immersion time which, as aforesaid, need not exceed 10 seconds but has no detrimental effect from a process viewpoint in exceeding this period.

The textile material may after leaving the draw nip device be subjected to a chain or chainless width-controlling washing step and thereafter be passed through a conventional multi-loop washer.

Additionally, the textile material may, between squeezing and reaching the draw nip device, be passed through an extended reaction time steam or liquid or steam above atmospheric pressure treatment chamber. The extended reaction time may be up to 10 minutes. Thus at this stage, the textile material may be maintained at an elevated temperature by treatment with steam vapour, either saturated at atmospheric pressure (100° C) or saturated at pressures above atmospheric pressure, or superheated steam at atmospheric pressure provided that in the latter case the textile material is not reduced in moisture content to the extent that any part of the surface configuraton of the textile material is brought near to dryness point. The reaction time is as aforesaid between 1 second and 10 minutes depending only on the concentration of caustic soda in use and the steam pressure and or temperature employed.

The simplified method of the present invention therefore provides the expected benefits of normal mercerisation produced from the immersion treatment as defined, these benefits including increases in the properties of dyestuff affinity, coverage of dead cotton, tensile strength, lustre and dimensional stability to laundering, and on the wide range of textile materials upon which we have carried out trials these benefits are not inferior to those obtained by normal mercerisation on similar fabrics.

In so far as the uniformity and thoroughness of our mercerisation treatment is vastly superior to that produced by normal mercerisation the method is further advantageous, and has substantial benefits due to lower operating costs of production.

Some novel effects produced by the method of our invention, especially when employing a longer reaction time whilst maintaining the elevated temperature of the caustic saturated material may be summarised as follows.

In the case of a loomstate material so treated, and which then requires scouring and or bleaching to develop the desired effect, the time of scouring and or bleaching and the concentration of reagents or the times and temperature conditions used may be substantially reduced, and in the case of some qualities of textile material which previously would have required a sequence of scour and bleach, then the pre-scour may be eliminated. The mercerising method according to our invention is especially advantageous when combined with a rapid bleach peroxide process for a so called "single stage" bleach and is especially noteworthy when a high pressure rapid bleach is used.

As may be seen from one of our Examples set out hereafter, only the high pressure bleach in conjunction with the process of this invention attains the necessary standard of cotton seed removal, degree of whiteness, and absorbency. This unexpected result showing a marked synergistic effect. Also whether mercerising according to our invention with immersion time plus minimum reaction time, or with immersion plus extended reaction times on loomstate, scoured and or bleached textile material, the material becomes much more pliable and less elastic than when such material is normally mercerising and the material may be stretched in length or width direction with less effort and to a greater degree with the production of a greater degree of lustre, but especially with a greater degree of dimensional stability to laundering, than by normal mercerising.

The method of this invention also includes such tensions applied to warp and or weft directions as will "overstretch" the textile material to a degree not previously practicable in normal mercerisation.

It is of course one of the attributes of normal mercerisation that it improves the tensile strength of the treated textile material, and it is equally well known that mercerising for optimum strength demands a yarn and fabric construction which responds best to the method: thus for different yarns and fabrics improvements in tensile strength by normal mercerisation have been reported from 10% to 40%.

Experiments with the method of this invention indicate that the optimum degree of overstretching will improve the percentage gain in tensile strength of a given yarn or fabric as obtained in normal mercerisation by a factor of 1.1 to 2.0.

Woven fabrics in the weft or width direction are especially vulnerable to washing shrinkage in subsequent laundering, because whereas potential warp shrinkage may be dealt with effectively by the compressive shrinking process at a later stage, the potential shrinkage in width of a final finished fabric is determined by the relationship between loomstate width and finished width and the nature of the processes that have occurred inbetween.

Conventional chain mercerisation is a means of obtaining the required weft dimensional stability with minimum loss of loomstate width, but we have found by experiment that the method of our invention will produce the required weft direction dimensional stability with even less loss in loomstate width of comparable materials.

It has also been found that the degree of overstretching to produce stability with least loss in width is not the same as that required to produce optimum weft tensile strength.

Cellulosic textile material processed according to our invention, and particularly when processed in the loomstate condition possesses a greater receptivity to dyestuffs and to these chemicals associated with the production of the so called "easy care" finishes, which usually comprise a treatment with "cross linking" resins, and which normally substantially improve the properties of crease resistance but impair the properties of tensile strength, tear strength and abrasion resistance, and we have found by experiment that textile materials mercerised according to our invention and subsequently "easy care" finished possess better physical characteristics for a similar level of easy care properties.

Also according to the present invention there is provided apparatus for carrying out the method according to the present invention and comprising means for saturating textile material with an alkaline swelling agent while under controlled conditions of elevated temperature and minimum tension, heating means for controlling the temperature of saturation, means for squeezing off surplus treatment liquor, and means for controlling tension in the length direction between the squeezing means and the entry to a subsequent controlled tension washing stage.

Means may be provided whereby the length of reaction time of the saturated textile material at an elevated temperature may be extended between the means for squeezing off surplus alkaline liquor and the entry to a first washing stage by providing a chamber within which the textile material is treated with steam atmospheric pressures or higher. Furthermore the method of this invention may employ the pre-washing chamber disclosed in our British patent specification No. 1,142,385 and which is either used for the purpose described in that Specification or utilised as a means of increasing the reaction time with or without the provision of steam heating as already described. Thereupon the textile material is subjected to controlled washing by any of the conventional washing apparatus for that purpose such as stabilising units of a chainless mercerising range or a chain washing section of a chain mercerising machine, and thereafter the washing is completed in conventional washing units.

By the method and apparatus of this invention textile material so processed possesses properties not less than and in some respects superior to those achieved by conventional mercerising at equivalent caustic soda concentration and a number of novel and valuable effects not associated with conventional mercerising may be produced according to selected conditions of the method and apparatus.

The method of this invention appears to be at variance with the fundamental theories concerning mercerisation which have been long established and part of standard text book teaching. This is not necessarily so while explanations at this stage are purely speculative it is considered useful to outline the present views as they do further explain the working of the method.

Caustic soda of semi and full mercerising concentrations as earlier defined, and at room temperatures or less is a liquid of high viscosity and high surface tension, both these properties increasing substantially as the concentration is increased.

Cotton yarn and woven or knitted material is highly hydrophobic unless subsequently scoured and or bleached to remove impurities; and woven material may be exceptionally hydrophobic when the warp threads have been sized to assist weaving.

Normal mercerisation is essentially a swelling process combined with controlled stretching, and the handicaps of the present conventional method lie chiefly in the difficulty of achieving uniform and thorough saturation with the alkaline liquor.

It is known that such effects are largely surface effects, the proportion being measurable by estimating the percentage of fully swollen fibers in a given sample of textile material.

It has also long been established that such effects are best produced on a cotton fiber of high quality, this usually being associated with the so called long staple quality in which the hair length is at a maximum.

It is likewise known that low quality cotton fibre, invariably of short hair length, responded badly to the mercerisation process, especially in respect of the acquisition of a silk-like lustre.

Prior to the advent of man-made fibres the only source of lustrous silk-like material lay therefore in the normal mercerisation of high quality cottons and these were produced in great quantities for high quality apparel.

When such fabrics are treated with "resins" for the purpose of improving easy care properties of cotton the loss in phyical characteristics was found unacceptable and as the coarser type cottons possess an intrinsically higher strength the latter type of cotton has become preponderant for such apparel, in spite of a less attractive appearance.

These lower quality cottons are characterised by a fibre hair of grossly irregular cross section shape, with a thick tough outer primary wall, and with a large proportion of immature growth cellulose in a sample of fibres.

As indicated, such quality of fibre responds badly to the normal mercerisation process even if the material has been previously rendered thoroughly absorbent to water.

The addition of surface active wetting agents has been widely practised and whilst these assist substantially in wetting a material with the caustic soda liquor, the effect appears to be to achieve uniform surface wetting of the fabric and yarn structure without materially assisting in the penetration of the caustic soda itself within the yarn and fabric structure and much less within the cotton hair itself.

The greater part of the research into the fundamental theories of normal mercerisation of cotton was carried out in a period when the fine quality cottons predominated and as recorded these responded best to all aspects of the process.

Thus as the object of mercerisation is primarily to achieve thorough and uniform swelling of the cotton hair itself this is difficult to achieve even with fine quality cotton, as in all types of yarn and fabric structure the greater the initial swelling of the structure the more difficult to penetrate beyond the surface structure.

It is known that caustic soda solutions at elevated temperatures cause less swelling of a cotton fibre hair than similar solutions at room temperature or less, this being a suggested reason advanced for mercerisation being ineffective at temperatures above room temperatures, and conversely special patented effects have long been produced by extremely high swelling effects which occur at temperatures less than 5° C. 5°.

However, in the operation of the method of this invention, carried out on the coarser quality cotton fibre structures which now predominate, wetting out of the structure is almost instantaneous and caustic soda penetrates uniformly within the material structure and fibre substance, swelling of the yarn and structure is less, thereby causing less hindrance to continued penetration, and in the case of treatment carried out on "loomstate" or "grey" material, in which the primary wall of the cellulosic hair has not been ruptured by combined scouring and or bleaching processes, the swelling of the cellulosic inner substance is largely contained within the primary wall, thus contributing less to a compacting of the material structure which as referred to is a hindrance to thorough penetration.

It is considered therefore that the balance of textile material properties so substantially improved by the method of this invention arises because the sum of the degree of swelling of all the individual hairs in a material structure brought about prior to the tension controlled washing stage is much greater in this method than by normal mercerisation, in spite of the degree of swelling of an individual hair being less than by the normal process; and the subsequent stretching stage is more efficient.

The total effect of this process is therefore substantially to upgrade the qualities of cotton textile materials now currently in volume production.

The following examples illustrate some aspects of our invention.

EXAMPLE 1

The effect of temperature of saturation with 50° TW caustic soda on the "add-on" or weight of caustic soda liquid picked up by a loomstate cotton fabric under otherwise identical saturation/squeezing conditions was recorded as follows:

| | Temperature | Add on % by weight |
|---|---|---|
| Normal mercerisation | 20° C | 67% |
| our method | 95° C | 125% |

EXAMPLE 2.

"Deconvolution" counts were measured on cross sections cut from the following fabrics. (All cotton shirting poplin single/single).

| | | |
|---|---|---|
| 1. | Loomstate fabric | 10.1 |
| 2. | Bleached and normal mercerised fabric /Commercially mercerised at 50° TW at 18° C). | 26.5 |
| 3. | Mercerised by the method of this invention. 50° TW elevated to 95° C (Loomstate "mercerised" and after-bleached). | 39.1 |

The lustre of fabrics 2 and 3 was the same.

EXAMPLE 3

Samples of all cotton poplin loomstate material were normally mercerised and mercerised by the method of this invention, both samples being tensioned to the same loading in the width (weft) dimension, and the stretched widths recorded. Both samples were subsequently laundered by the test method BS1118 and the respective widths again measured, these laundered widths representing zero residual shrinkage in the laundered samples.

A comparison of stretched widths and fully shrunk widths against the original loomstate width gave the following comparisons.

| | Loomstate | Stretched Widths | Laundered Widths |
|---|---|---|---|
| Normally Mercerised | 100 | 101.5 | 95.7 |
| Mercerised by the method of this invention. | 100 | 103.6 | 99.4 |

EXAMPLE 4

Smooth drying behaviour of all cotton fabrics without "easy-care" or resin finishing.

3 samples of all cotton poplin dress fabric 1/1 poplin were assessed for smooth drying behaviour by visual comparison with a Monsanto scale after giving each sample a 5 minute machine wash at 40° C and hanging to "drip-dry".

The samples had been processed as follows:

K.B. Scoured, bleached, NOT mercerised.

K.B.M. Scoured, normally mercerised and bleached.

L4. Mercerised according to this invention, scoured and bleached.

| | Scale Assessment | Comments |
|---|---|---|
| K.B. | 0 | Myriad sharp creases |
| K.B.M. | 1 | More and sharper creases than |
| L4 | 2 | |

EXAMPLE 5

Single stage peroxide bleaching.

Continuous lengths of an all cotton fabric were processed under the following conditions:

Fabric M.

Mercerised in loomstate according to the method of this invention with 50° TW caustic soda, elevated to 80° C for an immersion time of 10 seconds with a reaction time of 35 seconds in a closed chamber but without additional heating.

Fabric B.

Mercerised in loomstate by a normal mercerising method with 50° TW caustic soda at 18° C with a total "dwell time" of 45 seconds.

Fabrics M and B were then divided into lengths numbered 1 to 4 and given a series of separate single stage peroxide bleaches under the following conditions:

1. Open width pressure bleach
   2% hydrogen peroxide (plus appropriate additives)
   2 minutes dwell
   2 atmospheres pressure (133° C)
2. Open width atmospheric bleach
   3% hydrogen peroxide (plus appropriate additives)
   3 minutes dwell at 100° C
3. As 2 for 5 minutes dwell at 100° C
4. As 2 for 10 minutes dwell at 100° C The cotton fabric was of a type known as "Indian Head" plain weave of American medium staple length fibre with such amount of cotton seed present as would normally require a 2 stage sequence of a caustic alkaline scour followed by a peroxide bleach to achieve the necessary quality results.

The processed samples were then tested in the laboratory as follows:

For : Whiteness - by Harrison Reflectometer Z = 88%
Absorbency- A.A.T.C.C. Method 79 - 1972
Fluidity - BS 2610
The results were found to be as follows :

| | Whiteness Reflectance | Absorbency | Fluidity |
|---|---|---|---|
| M1 | 75.8 | 3.2 | 3.62 |
| M2 | 75.0 | 4.2 | 2.96 |
| M3 | 75.1 | 5.9 | 3.31 |
| M4 | 77.0 | 10.0 | 3.74 |
| B1 | 66.0 | 10.0 | 3.85 |
| B2 | 60.0 | Greater than 300 | 4.19 |
| B3 | 67.0 | Greater than 300 | 6.36 |
| B4 | 72.4 | Greater than 300 | 5.25 |

It will be observed that only pressure bleaching produced a fabric with an absorbency of 10 or under, and only pressure bleaching in combination with fabric M produced a satisfactory degree of Whiteness, and visually seed removal was complete on all M series, whereas seed was markedly present on B1 and B2 and still discernible on B3 and B4.

EXAMPLE 6

Continuous lengths of fabric comprising cotton with ⅔ polyester fiber in blend, and 100% cotton containing a proportion of multi-coloured yarns were (a) normally mercerised (b) mercerised according to the method of this invention to compare the effect of cold caustic soda with caustic soda at elevated tempratures.

Both types of fabric behaved identically under conditions (a) and (b) whether assessed visually or by various methods of test.

Embodiments of apparatus suitable for carrying out the new mercerising method in accordance with the present invention will now be described, with reference to the accompanying diagrams, in which.

Figures 1, 2, 3:
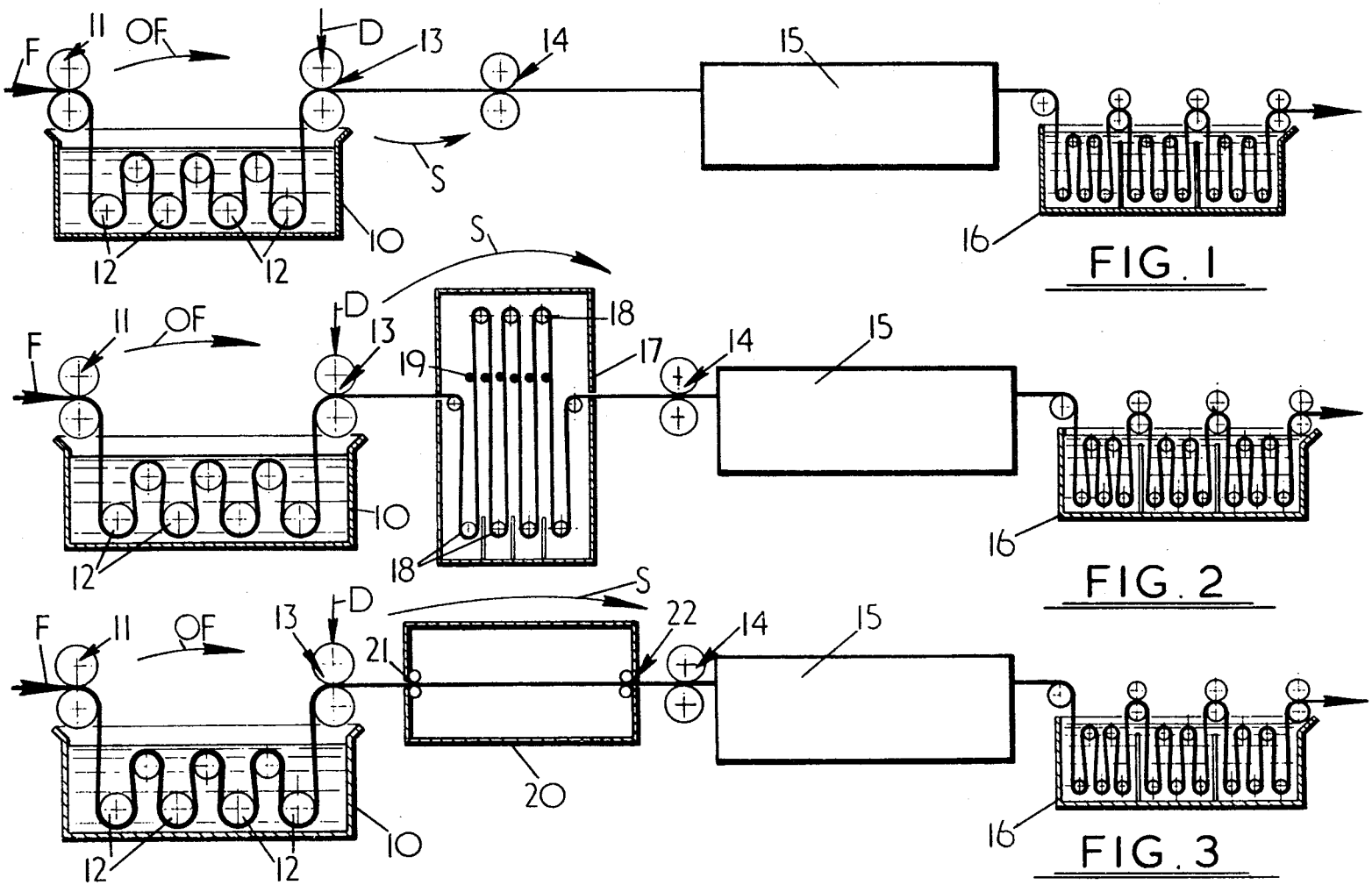
FIG. 1 illustrates the basic saturation/squeeze sequence allied to the necessary tension controls, and followed by conventional width controlled washing, whether chain or chainless, and the final multi-box washers.
FIG. 2 illustrates the addition of a chamber in which an extended reaction time takes place, followed by the two conventional types of washing as FIG. 1.
FIG. 3 illustrates the addition of a chamber in which an extended reaction time takes place at temperatures relevant to pressure above atmospheric pressure.

All components of the various apparatus are long-established and well known to those skilled in the textile art and for this reason they have been shown in extreme diagrammatic form.

In FIG. 1, the fabric is indicated by reference F and it is fed with overfeed indicated by arrow OF through a tank 10 containing caustic soda solution of concentration of 8.75% or more at a temperature of 50° C or more. The fabric F travels from an entry nip 11 in a sinuous path round large diameter driven rolls 12 to a heavy mangle squeeze nip 13 which provides a datum speed indicated by arrow D. Fabric F is then passed through a draw nip 14 and is stretched between nip 13 and nip 14 as indicated by arrow S. The nips 11, 13 and 14 are driven by a positive infinitely variable drive to indicate percentage loss/gain in fabric length. Automatic lever and temperature controls are provided for the tank 10. The draw nip 14 is followed by a conventional width-control chain or chainless washer 15 and then by a conventional multi-loop washer 16.

The apparatus of FIG. 2 is identical with that of FIG. 1 save that between nips 13 and 14 there is an extended reaction time chamber 17 for steam or liquid treatment and in which the fabric F is conducted in an elongate sinuous path over rollers 18. Intermediate spacer rods or rollers are indicated at 19. Washers 15 and 16 are again provided.

The apparatus of FIG. 3 varies from that of FIG. 2 in that chamber 17 is replaced by a reaction time chamber 20 with entry and exit seals 21 and 22 in which the fabric F is treated by steam above atmospheric pressure. The chamber 20 may be a straight pass as shown or of the roller type for ultra short reaction times, or for extended reaction times it may be a conveyor or roller bed conveyor on which the fabric F lies relaxed provided that subsequent appropriate lengthway stretch devices are provided before entry to washer 15.

All the apparatus exemplified in FIGS. 1 to 3 may be operated as self contained units or in line with open width scouring/bleaching ranges.

Apparatus has not been illustrated for the continuous mercerising of yarn by our invention, but this may be carried out either on a single yarn basis or on a sheet of parallel warp way yarns, in which the apparatus would provide the same sequence as that described for fabric, viz. relaxed saturation/squeeze, stretch (with or without extended reaction time) and followed by washing under controlled lengthway tension until the caustic content of the yarn is below 5% thereafter followed by normal final washing to neutrality.

What is claimed is:

1. A method of mercerizing unregenerated cellulosic textile material derived from spun yarns comprising the steps of presenting the textile material for saturation with an alkaline swelling agent at a concentration of 8.75% or more and at a temperature of 50° C or more for an immersion time of 10 seconds or less, and squeezing excess agent from the textile material, said agent being caustic soda, the material being cotton fabric.

2. A method as claimed in claim 1, comprising the step of controlling the textile material during the immersion time in respect of changes in length and/or in width.

3. A method as claimed in claim 1, comprising the steps, after squeezing, of delivering the textile material to a draw nip device, and controlling, between squeezing and the draw nip device, the textile material in respect of changes in length and/or width during a reaction time in excess of 1 second.

4. A method as claimed in claim 1 in which the alkaline swelling agent is caustic soda at a concentration between 8.75% and 31%.

5. A method as claimed in claim 1 in which the temperature is just below the boiling point of the selected concentration of alkaline swelling agent solution.

6. A method as claimed in claim 3 in which the reaction time does not exceed 10 minutes.

7. A method as claimed in claim 1, comprising, between squeezing and arrival at the draw nip device, subjecting the textile material, while it is saturated with the caustic soda, to a treatment step for intensifying the action of the caustic soda, said treatment step being selected from treating the textile material at atmospheric pressure with saturated steam at 100° C, or with superheated steam above 100° C, or with saturated steam at above atmospheric pressure and at temperatures in excess of 100° C.

8. A method as claimed in claim 7 comprising, after the draw nip, subjecting the textile material to width-controlled washing and thereafter substantially relaxed washing.

9. A method of mercerizing unregenerated cellulosic textile material derived from spun yarns comprising the steps of presenting the textile material for saturation with an alkaline swelling agent at a concentration of 8.75% or more and at a temperature of 50° C or more for an immersion time of 10 seconds or less, and squeezing excess agent from the textile material, said agent being caustic soda, the textile material being a fabric containing cotton.

10. A method as defined in claim 9, wherein the fabric is a mixture of cotton and polyester.

11. The method of claim 10, wherein the fabric is cotton with $\frac{2}{3}$ polyester fiber in blend.

* * * * *